US010837235B2

(12) United States Patent
Liu et al.

(10) Patent No.: US 10,837,235 B2
(45) Date of Patent: Nov. 17, 2020

(54) HYBRID ROTARY GUIDING DEVICE

(71) Applicant: Institute of Geology and Geophysics, Chinese Academy of Sciences, Beijing (CN)

(72) Inventors: Qingbo Liu, Beijing (CN); Qingyun Di, Beijing (CN); Tsili Wang, Beijing (CN); Wenxuan Chen, Beijing (CN); Jiansheng Du, Beijing (CN); Yongyou Yang, Beijing (CN); Xinzhen He, Beijing (CN); Linfeng Hong, Beijing (CN); Qijun Xie, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/348,096

(22) PCT Filed: Mar. 2, 2018

(86) PCT No.: PCT/CN2018/000084
§ 371 (c)(1),
(2) Date: May 7, 2019

(87) PCT Pub. No.: WO2019/095525
PCT Pub. Date: May 23, 2019

(65) Prior Publication Data

US 2020/0263503 A1 Aug. 20, 2020

(30) Foreign Application Priority Data

Nov. 14, 2017 (CN) ..... 2017 1 1119985

(51) Int. Cl.
*E21B 7/06* (2006.01)
*E21B 17/10* (2006.01)
*E21B 47/024* (2006.01)

(52) U.S. Cl.
CPC ..... *E21B 7/067* (2013.01); *E21B 7/068* (2013.01); *E21B 17/1014* (2013.01); (Continued)

(58) Field of Classification Search
CPC ..... E21B 7/067; E21B 7/068; E21B 17/1014
See application file for complete search history.

(56) References Cited

U.S. PATENT DOCUMENTS 3,743,034 A * 7/1973 Bradley ..... E21B 7/06 175/61
6,209,664 B1 4/2001 Amaudric Du Chaffaut
(Continued)

FOREIGN PATENT DOCUMENTS

CN 102865038 A 1/2013
CN 104563867 A 4/2015
(Continued)

*Primary Examiner* — Nicole Coy
(74) *Attorney, Agent, or Firm* — Birch, Stewart, Kolasch & Birch, LLP

(57) ABSTRACT

A hybrid rotary guiding device, includes: rotating shaft, the rotating shaft is used to drive the head of a drill tool to rotate, the rotating shaft includes an upper shaft portion, a lower shaft portion, and a steerable portion, a separation distance exists between the upper shaft portion and the lower shaft portion in the axial direction, the upper shaft portion and the lower shaft portion are steerably connected by the steerable portion; the upper shaft portion is installed with at least three first hydraulic mechanisms, and the lower shaft portion is installed with at least three second hydraulic mechanisms, the second hydraulic mechanism is adapted to drive a pushing member against the wall of the well to guide the head of a drill tool, the first hydraulic mechanism and the (Continued)

second hydraulic mechanism are configured so that the first hydraulic mechanism can drive the second hydraulic mechanism to drive the pushing member. The present invention combines the advantages of directional and push-oriented guidance, the influence of formation properties on the build-up slope is largely eliminated, a higher build rate can be provided, and the demand for energy consumption is greatly reduced.

5 Claims, 1 Drawing Sheet

(52) U.S. Cl.
CPC ..... *E21B 7/061* (2013.01); *E21B 7/062* (2013.01); *E21B 47/024* (2013.01)

(56) References Cited

U.S. PATENT DOCUMENTS

| | | | | |
|---|---|---|---|---|
| 9,145,736 | B2 * | 9/2015 | Peter | E21B 7/067 |
| 9,476,263 | B2 * | 10/2016 | Clausen | E21B 7/06 |
| 10,267,091 | B2 * | 4/2019 | Peter | E21B 4/003 |
| 10,683,702 | B2 * | 6/2020 | Conger | E21B 34/06 |
| 2003/0127252 | A1 * | 7/2003 | Downton | E21B 7/067 175/73 |
| 2009/0272579 | A1 * | 11/2009 | Sihler | E21B 44/02 175/45 |
| 2012/0018225 | A1 | 1/2012 | Peter et al. | |
| 2014/0209389 | A1 | 7/2014 | Sugiura et al. | |
| 2016/0326804 | A1 * | 11/2016 | Gao | E21B 17/1014 |
| 2017/0107762 | A1 | 4/2017 | Marson | |
| 2017/0234115 | A1 | 8/2017 | Sandkleiva | |
| 2018/0016844 | A1 * | 1/2018 | Peters | E21B 47/06 |
| 2018/0016845 | A1 * | 1/2018 | Peters | E21B 7/067 |
| 2020/0190909 | A1 * | 6/2020 | Liu | E21B 7/068 |

FOREIGN PATENT DOCUMENTS

| | | | |
|---|---|---|---|
| CN | 105051316 | A | 11/2015 |
| CN | 104619944 | B | 9/2016 |
| CN | 205713975 | U | 11/2016 |
| CN | 107060643 | A | 8/2017 |

* cited by examiner

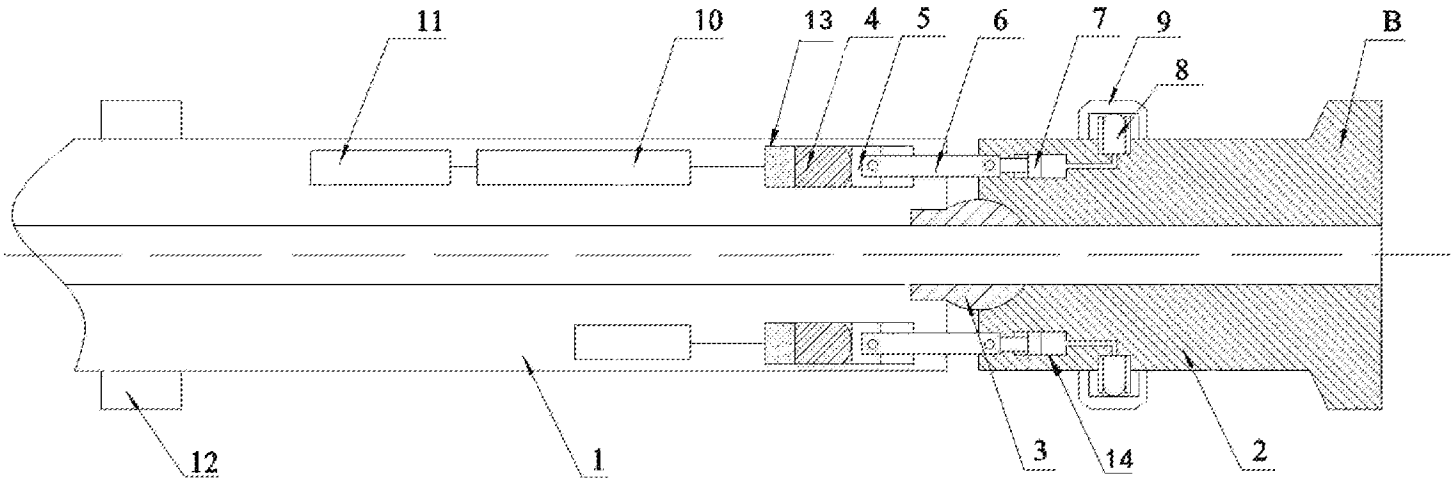
B
9
8
7
6
5
4
13
10
11
2
14
3
1
12

HYBRID ROTARY GUIDING DEVICE

TECHNICAL FIELD

The invention relates to the field of drilling, and more particularly to a hybrid rotary guiding device that controls drilling guidance.

BACKGROUND TECHNOLOGY

In order to obtain natural resources storaged underground, drilling exploration is required. In many cases, the wellbore and the derrick are not aligned, but need to form a certain offset or bend. This process of forming horizontal or vertical offsets or other types of complex holes is called directional drilling. In the process of directional drilling, the direction control of the drill bit is called guidance. Modern directional drilling has two types: sliding guidance and rotary guidance. The drill string does not rotate when sliding guiding drilling; the bottom hole power drill (turbine drill, screw drill) drives the drill bit to rotate. The screw drilling tool and part of the drill string and the centralizer can only slide up and down against the well wall. Its shortcomings are large friction, effective weight-on-bit, low torque and power, low drilling rate, the wellbore spiralled and unsmooth and unclean, poor quality, easy to accident, and often forced to start the drill disc with "composite drilling", and "composite drilling" is often limited to use. The limit depth of sliding guidance is less than 4000 m. In order to change the orientation of the hole, it is necessary to change the structure of the drill string. Rotary steerable drilling system is the rotary drive of the drill string, the drill string and the rotary guiding tool are rolled on the well wall, and the rolling friction resistance is small. The rotary steerable drilling system can control and adjust its slanting and orienting function during drilling, and can complete the slanting, increasing the slope, stabilizing the slope and descending the slope along with the drilling process, and the friction is small, the torque is small, the drilling speed is high, larger drill bit penetration, the aging is high, the cost is low, and the well shaft is easy to control. With a limit of 15 km, it is a new type of weapon for drilling complex structural wells and offshore oil systems and super-large displacement wells (10 km).

There are also two commonly used rotary guiding technologies, one is a directional guidance and the other is a push-oriented guidance. The Chinese authorized patent CN104619944B obtained by the American company Halliburton discloses a directional guiding tool, which provides modular actuators, guiding tools and rotary steerable drilling systems, the modular actuator includes a barrel portion, and the modular actuator is configured to be coupled to an outer circumference of the outer casing. The accumulator is housed in the barrel portion, and a hydraulically actuated actuator is slidably disposed within the barrel portion, the actuator is moveable between an activated position and an inactive position such that the actuator piston selectively squeezes the ramped surface of the drive shaft to change the direction of the drill string. The U.S. patent application US20140209389A1 discloses a rotary guiding tool, which comprises a non-rotating sleeve, a rotating shaft comprising a deflectable unit, the deflection unit being deflected by controlling the circumferential position of the eccentric bushing, thereby adjusting the drilling direction of the drill bit. Another type of rotary steering technique, namely push-oriented rotary guidance technology, is disclosed in US Patent Application No. US20170107762A1, it includes a pushing member disposed around the drill pipe and a hydraulic drive system for driving the pushing member, and the hydraulic drive system selectively drives the pushing member to move between the abutment position and the non-push position, in the abutment position, the pushing member can push against the wall of the well in a slapping way to generate guiding force and change the direction of the drilling hole.

Both the directional guidance and the push-oriented guidance have their own characteristics. Generally speaking, the slope of the directional guidance is relatively stable, which is less affected by the drilling pressure and formation conditions, but the limit value of the slope is low, and it is difficult to meet the requirements when a high build-up slope is required. Relatively speaking, the slope of the push-oriented guidance is not stable, and it is greatly affected by the drilling pressure and formation conditions, when the drilling pressure is low and the hardness of the formation is appropriate, the slope is large, and the well trajectory can be quickly adjusted, however, the guiding ability is reduced when the soft formation is encountered.

Recently, some people have proposed hybrid guidance tools, however, the driving method for providing driving force has not been well realized. In addition, the difficulty of measurement and control and the energy consumption problem in the underground are also very important. On the one hand, when the downhole component rotates with the drill pipe, it will cause difficulty in measuring the corresponding component, which is a problem that cannot be ignored, and how to make data measurement simple is an important issue; On the other hand, underground energy is mainly from mud power generation, in addition to ensuring the operation of the electronic components downhole, it is also necessary to provide the energy required to guide the drive, and it is also important to provide a guided drive with as low power as possible.

Therefore, the prior art requires a high-slope-while-drilling rotary guided drive technology to reduce the control difficulty.

SUMMARY OF THE INVENTION

In order to solve the above problems, the invention proposes a hybrid rotary guiding device, comprising: rotating shaft, the rotating shaft is used to drive a tool head to rotate, the rotating shaft includes an upper shaft portion, a lower shaft portion, and a steerable portion, a separation distance exists between the upper shaft portion and the lower shaft portion in the axial direction, the upper shaft portion and the lower shaft portion are steerably connected by the steerable portion; the upper shaft portion is installed with at least three first hydraulic mechanisms, and the lower shaft portion is installed with at least three second hydraulic mechanisms, the second hydraulic mechanism is adapted to drive a pushing member against the wall of the well to guide the tool head, the first hydraulic mechanism and the second hydraulic mechanism are configured so that the first hydraulic mechanism can drive the second hydraulic mechanism to drive the pushing member.

Preferably, the first hydraulic mechanism and the second hydraulic mechanism are connected by a connecting rod, and the both ends of the connecting rod are respectively hinged with the first hydraulic mechanism and the second hydraulic mechanism.

Preferably, the first hydraulic mechanism includes a first hydraulic chamber disposed in the upper shaft portion and a first piston disposed in the first hydraulic chamber, the first piston is adapted to drive one end of the connecting rod to move axially; the second hydraulic mechanism includes a second hydraulic chamber disposed in the lower shaft portion and a second piston disposed in the second hydraulic chamber; the connecting rod is adapted to drive the pushing member to move generally radially along the lower shaft portion.

Preferably, the first hydraulic mechanism further includes a first slider disposed in the first hydraulic chamber, the first piston is adapted to drive the first slider; the second hydraulic mechanism further includes a second slider disposed in the second hydraulic chamber, the second slider is adapted to drive the second piston; one end of the connecting rod is hinged with the first slider, and the other end of the connecting rod is hinged with the second slider.

Preferably, a limited structure is arranged on the lower shaft portion, the limited structure limits the range of radial movement of the pushing member.

Preferably, the steerable portion includes a universal transmission member or a flexible shaft.

The hybrid rotary guide device proposed by the present invention can provide a larger range of selectable slopes to meet different formation requirements. At the same time, for the pushing part in the hybrid guiding, it no longer needs to drive the entire drilling tool assembly, but only needs to drive the lower shaft portion to rotate around the steerable portion for guiding, which greatly saves the consumption energy for guiding under the well.

BRIEF DESCRIPTION OF THE DRAWINGS

The drawings described herein are intended to provide a further understanding of the invention, and are intended to be a part of this invention. The schematic embodiments of this invention and their descriptions are used to interpret this invention and do not constitute an undue limitation of this invention. In the drawing:

FIG. 1 is a hybrid rotary guiding device according to the first embodiment of the invention.

DETAILED DESCRIPTION

In order to explain the overall concept of the present invention more clearly, the following detailed description is illustrated by way of example with reference to the attached drawings. It should be noted that, in this context, relational terms such as "first" and "second" are used to distinguish one entity or operation from another entity or operation, and it is not necessary to require or imply that there is such an actual relationship or order between these entities or operations.

Furthermore, the terms "including", "comprising" or any other similar description is intended to cover a non-exclusive contain, which leads to a series of processes, methods, objects, or equipment not only include the elements listed in the context, but also include other elements which is not listed in the context, or the inherent elements of the processes, methods, objects, or equipment. In the absence of further restrictions, elements defined by the statement "including one" are not excluded from the inclusion, but include other identical elements.

The rotary guiding device disclosed herein relates to application scenarios for oilfield drilling or other exploration drilling. Other system components associated with rotary guiding device, such as derrick systems, powertrains, and signaling systems, are not described extensively here.

EMBODIMENT

As shown in FIG. 1, the embodiment proposes a rotary guiding device. In this embodiment, the rotary guiding device belongs to a hybrid rotary guiding device. Specifically, the hybrid rotary guiding device includes: rotating shaft, the rotating shaft includes an upper shaft portion 1, a lower shaft portion 2, and a steerable portion 3, a separation distance exists between the upper shaft portion 1 and the lower shaft portion 1 in the axial direction, and the separation distance can provide a space for the rotation of the lower shaft portion 2 relative to the upper shaft portion 1. The upper shaft portion 1 and the lower shaft portion 2 are steerably connected by the steerable portion 3. Thereby, under the driving force, the lower shaft portion 2 connected to the tool head B can provide guidance in a partially movable manner without the need to drive the entire drill tool assembly.

As shown in FIG. 1, the hybrid rotary guiding device also includes at least three first hydraulic mechanisms installed on the upper shaft portion 1 and at least three second hydraulic mechanisms installed on the lower shaft portion 2, the second hydraulic mechanism 14 is adapted to drive a pushing member 9 against the wall of the well to guide the tool head B, the first hydraulic mechanism 13 and the second hydraulic mechanism 14 are configured so that the first hydraulic mechanism 13 can drive the second hydraulic mechanism 14 to drive the pushing member 9. Due to the connection of the first hydraulic mechanism 13 and the second hydraulic mechanism 14, during the drive of the first hydraulic mechanism 13, on the one hand, the driving force can provide the directional guiding force, and on the other hand, the driving force of the first hydraulic mechanism 13 can also provide power to the second hydraulic mechanism 14, and the pushing member 9 is driven in turn.

In the process of drilling, in addition to providing the pushing force, the pushing member 9 can also act as a centralizer together with the upper centralizer 12, and jointly provide a stable and positive supporting force for the drilling tool assembly. Especially when the tool head needs to maintain the current state and orientation, the hydraulic mechanism provides the same force for each of the pushing member 9 so that the pushing member can rest against the well wall to maintain the direction of the drill tool assembly.

The first hydraulic mechanism 13 and the second hydraulic mechanism 14 are connected by a connecting rod 6, and the both ends of the connecting rod 6 are respectively hinged with the first hydraulic mechanism 13 and the second hydraulic mechanism 14. Through the connection of the connecting rod 6, the driving force of the first hydraulic mechanism 13 can be transmitted to the second hydraulic mechanism 14 to provide a force for the pushing member 9. And since both ends of the connecting rod 6 are respectively hinged with the first hydraulic mechanism 13 and the second hydraulic mechanism 14 the lower shaft portion 2 has a degree of freedom for guiding with respect to the upper shaft portion 1.

The first hydraulic mechanism 13 includes a first hydraulic chamber disposed in the upper shaft portion 1 and a first piston 4 disposed in the first hydraulic chamber, the first piston 4 is adapted to drive one end of the connecting rod 6 to move axially; the second hydraulic mechanism 14 includes a second hydraulic chamber disposed in the lower shaft portion 2 and a second piston 8 disposed in the second hydraulic chamber; the connecting rod 6 is adapted to drive the pushing member 9 to move generally radially along the lower shaft portion 2.

The first hydraulic mechanism 13 further includes a first slider 5 disposed in the first hydraulic chamber, the first piston 4 abuts against the first slider 5, and when the hydraulic pressure in the hydraulic chamber drives the first piston 4 to move to the right, the first piston 4 can drive the first slider 5 move to the right, which in turn drives the connecting rod 6 to move. The second hydraulic mechanism 14 further includes a second slider 7 disposed in the second hydraulic chamber, the second slider 7 is adapted to drive the second piston. One end of the connecting rod 6 is hinged with the first slider 5, and the other end of the connecting rod 6 is hinged with the second slider 7.

In a part of the FIGURE that is not shown, a limited structure is arranged on the lower shaft portion 2, the limited structure limits the range of radial movement of the pushing member 9. The limited structure enables the pushing member 9 to have an upper limit position and a lower limit position in the radial direction. When there is no driving force to act on the pushing member 9, the pushing member 9 is in a free state, and the force from the well wall does not generate a reaction force to the lower shaft portion 2 by the pushing member 9. When a driving force acts on the pushing member 9, the pushing member 9 projects outward and acts on the well wall, and the force from the well wall can generate a reaction force to the lower shaft portion 2.

The steerable portion shown in FIG. 1 is a universal transmission member. However those skilled in the art will appreciate that the steerable portion can also be a flexible shaft.

As shown in FIG. 1, the upper shaft portion 1 further includes a hydraulic unit 10 and a circuit cavity 11.

In a preferred embodiment not shown in detail in FIG. 1, the guiding drive mechanism comprises at least three pushing members, every pushing member 9 is adapted to move in the radial direction of the rotating shaft to push against the well wall to change the direction of the tool head.

Each of the pushing member 9 is connected to and driven by the aforementioned hydraulic drive mechanism. In the embodiment shown in FIG. 1, the pushing member 9 acts in conjunction with the wall of the well to provide a guiding drive force, while the pushing member is also capable of acting as a centralizer. The first piston 4 drives the first slider 5 to drive the connecting rod 6, the connecting rod 6 drives the second slider 7 to drive the second piston 8, which drives the pushing member 9 to move.

The lower shaft portion 2 is provided with a limited structure or a limited device (not shown) for limiting the range of movement of the pushing member 9, so that the pushing member 9 can move radially within a defined range. In the process of guiding and driving, the second piston 8 drives the pushing member 9 to move radially outwardly and push against the well wall to produce a guiding drive force. For example, the guiding driving mechanism can have three hydraulic driving mechanisms and three pushing members 9, on the one hand, the three hydraulic driving mechanisms can respectively make the lower shaft portion generate a certain torque with respect to the steerable portion 3, and the sum of the three torques is the actual axially driven torque, on the other hand, each of the three pushing members 9 can also generate a radial force, which can also generate a torque with respect to the steerable portion 3, and the sum of the torques acting on the steerable portion 3 forms the current guiding driving force.

What is advantageous to improve the build-up slope is that the hybrid rotary guiding device provided by the present embodiment can combine the advantages of the directional guidance and the push-oriented guidance, and the influence of the formation property on the build-up slope can be largely eliminated. Meanwhile, in the driving structure provided by the embodiment, the direction of the torque generated by the axial driving force generated in the single driving chain is consistent with the direction of the torque generated by the radial driving force, and the build-up slope is a superposition of the two, and thus provides a higher build slope. On the other hand, the hybrid rotary guiding device provided by the embodiment does not need to push against the entire drill tool assembly when pushing against the well wall, but only needs to push against the lower shaft portion, and in this way the energy consumption requirement of the entire device is greatly reduced.

The various embodiments in the specification are described in a progressive manner, and the same or similar parts between the various embodiments can be referred to each other, and each embodiment focuses on differences from the other embodiments. Particularly, for the system embodiment, since it is basically similar to the method embodiment, the description is relatively simple, and the relevant parts can be referred to the description of the method embodiment.

The above description is only the embodiment of the present application and is not intended to limit the application. Various changes and modifications can be made to the present application by those skilled in the art. Any modifications, equivalents, improvements, etc. made within the spirit and scope of the present application are intended to be included within the scope of the claims.

The invention claimed is:

1. A hybrid rotary guiding device, comprising:

a rotating shaft, wherein the rotating shaft is used to drive a tool head to rotate, the rotating shaft includes an upper shaft portion, a lower shaft portion, and a steerable portion, a separation distance exists between the upper shaft portion and the lower shaft portion in the axial direction, the upper shaft portion and the lower shaft portion are steerably connected by the steerable portion;

wherein the upper shaft portion is installed with at least three first hydraulic mechanisms, and the lower shaft portion is installed with at least three second hydraulic mechanisms, each of the first hydraulic mechanisms is respectively connected to a corresponding one of the second hydraulic mechanisms, the corresponding first and second hydraulic mechanisms are connected by a connecting rod, and both ends of the connecting rod are respectively hinged with the corresponding first and second hydraulic mechanisms, each of the second hydraulic mechanisms is adapted to drive a pushing member against the wall of the well to guide the tool head, the corresponding first and second hydraulic mechanisms are configured so that each of the first hydraulic mechanisms can drive the corresponding one of the second hydraulic mechanisms to drive the pushing member.

2. The hybrid rotary guiding device of claim 1, wherein each of the first hydraulic mechanisms includes a first hydraulic chamber disposed in the upper shaft portion and a first piston disposed in the first hydraulic chamber, the first piston is adapted to drive one end of the connecting rod to move axially; each of the second hydraulic mechanisms includes a second hydraulic chamber disposed in the lower shaft portion and a second piston disposed in the second hydraulic chamber; the connecting rod is adapted to drive the pushing member to move generally radially along the lower shaft portion.

3. The hybrid rotary guiding device of claim 2, wherein each of the first hydraulic mechanisms further includes a first slider disposed in the first hydraulic chamber, the first piston is adapted to drive the first slider; each of the second hydraulic mechanisms further includes a second slider disposed in the second hydraulic chamber, the second slider is adapted to drive the second piston; one end of the connecting rod is hinged with the first slider, and the other end of the connecting rod is hinged with the second slider.

4. The hybrid rotary guiding device of claim 1, wherein a limited structure is arranged on the lower shaft portion, the limited structure limits the range of radial movement of the pushing member.

5. The hybrid rotary guiding device of claim 1, wherein the steerable portion includes a universal transmission member or a flexible shaft.

* * * * *